US009303293B2

(12) United States Patent
Parodi et al.

(10) Patent No.: US 9,303,293 B2
(45) Date of Patent: Apr. 5, 2016

(54) SYNTHETIC QUENCHING FLUID COMPOSITION

(71) Applicant: A. & A. Fratelli Parodi S.p.A., Campomorone (IT)

(72) Inventors: Augusto Parodi, Genoa (IT); Leandro Marini, Ceranesi (IT); Felice Matta, Buttigliera d'Asti (IT); Simone Bianchi, Vespolate (IT)

(73) Assignee: A. & A.Fratelli Parodi S.p.A., Campomorone (IT)

( * ) Notice: Subject to any disclaimer, the term of this patent is extended or adjusted under 35 U.S.C. 154(b) by 191 days.

(21) Appl. No.: 14/101,101

(22) Filed: Dec. 9, 2013

(65) Prior Publication Data

US 2014/0261926 A1 Sep. 18, 2014

(30) Foreign Application Priority Data

Dec. 10, 2012 (EP) ..... 12196309

(51) Int. Cl.
*C21D 1/56* (2006.01)
*C10M 105/38* (2006.01)

(52) U.S. Cl.
CPC ..... *C21D 1/56* (2013.01); *C10M 105/38* (2013.01); *C10M 2207/026* (2013.01); *C10M 2207/2835* (2013.01); *C10M 2215/064* (2013.01); *C10M 2215/223* (2013.01); *C10M 2219/044* (2013.01); *C10N 2230/10* (2013.01); *C10N 2230/64* (2013.01); *C10N 2240/00* (2013.01)

(58) Field of Classification Search
CPC ..... C10M 105/22; C10M 105/24; C10M 105/26; C10M 105/38; C10M 2207/2835; C10M 2207/026; C10M 2215/223; C10M 2215/064; C10M 2219/044; C10N 2230/10; C10N 2230/64; C10N 2240/00; C21D 1/56
USPC ..... 106/14.05, 14.27, 14.29
See application file for complete search history.

(56) References Cited

U.S. PATENT DOCUMENTS

| | | | | |
|---|---|---|---|---|
| 3,281,288 | A | 10/1966 | Carver | |
| 5,422,024 | A * | 6/1995 | Vickerman et al. | 508/506 |
| 8,070,885 | B2 * | 12/2011 | Busatto | 148/29 |
| 9,066,860 | B2 * | 6/2015 | Nagare et al. | |
| 2008/0096777 | A1 | 4/2008 | Costello et al. | |

FOREIGN PATENT DOCUMENTS

WO 2004/099450 11/2004

OTHER PUBLICATIONS

Brennan, R.J. et al., "A Quenchant Based on Canola Oil", Advanced Materials & Processes, pp. 32S-35U, Aug. 1997.

* cited by examiner

*Primary Examiner* — Anthony J Green
(74) *Attorney, Agent, or Firm* — Fish & Tsang, LLP

(57) ABSTRACT

A fluid composition is prepared by esterification of (a) at least one synthetic alcohol and (b) a mixture of fatty acids, including at least oleic and linoleic acids, and at least one of a mixture comprising a Miristic acid, Palmitoleic acid, Margarinic acid, Margaroleic acid, α-Linoleic acid, Arachidic acid, Eicosenoic Behenic acid, and Erucic acid. The fatty acids can also include at least one of stearic acid and palmitic acid. The composition can be used as, or as part of, a quenching bath for a metal.

10 Claims, 2 Drawing Sheets

| Bath Temperature: 40°C | | Bath Temperature: 80°C | | Bath Temperature: 120°C | |
|---|---|---|---|---|---|
| CRmax | 93 | CRmax | 98 | CRmax | 99 |
| TmaxCR | 654 | TmaxCR | 661 | TmaxCR | 657 |
| CR400[°C/s] | 29.23 | CR400[°C/s] | 29.37 | CR400[°C/s] | 27.91 |
| CR300[°C/s] | 6.68 | CR300[°C/s] | 5.74 | CR300[°C/s] | 4.69 |
| time 600°C [s] | 5.11 | time 600°C [s] | 5.14 | time 600°C [s] | 5.39 |

CRmax = Maximum cooling rate
TmaxCR = Temperature of the maximum cooling rate
CR400 = Cooling rate at 400°C
CR300 = Cooling rate at 300°C
time 600°C = time to reach 600°C

| Bath Temperature: 40°C | | Bath Temperature: 80°C | | Bath Temperature: 120°C | |
|---|---|---|---|---|---|
| CRmax | 92 | CRmax | 104 | CRmax | 104 |
| TmaxCR | 702 | TmaxCR | 708 | TmaxCR | 712 |
| CR400[°C/s] | 13.55 | CR400[°C/s] | 13.15 | CR400[°C/s] | 9.32 |
| CR300[°C/s] | 6.30 | CR300[°C/s] | 5.40 | CR300[°C/s] | 4.25 |
| time 600°C [s] | 4.62 | time 600°C [s] | 4.40 | time 600°C [s] | 3.66 |

CRmax = Maximum cooling rate
TmaxCR = Temperature of the maximum cooling rate
CR400 = Cooling rate at 400°C
CR300 = Cooling rate at 300°C
time 600°C = time to reach 600°C

SYNTHETIC QUENCHING FLUID COMPOSITION

This application claims priority to EPO application ser. no. EP 12196309.4, filed Dec. 10, 2012.

FIELD OF THE INVENTION

The present invention relates to a new synthetic quenching fluid composition used in the heat treatment of metals, comprising a mixture of synthetic oils and the use thereof.

BACKGROUND

An appropriate quenching technique has always been an extremely important part of the heat treatment process of metals. Expensive, high value treated parts could result damaged if insufficient attention is paid to proper quenching procedure and means. The choice of the operative tempering conditions is therefore essential in view of the structural features and the technological aims which have to be reached.

Selection of a quenching agent is primarily governed by the processing specifications, the required physical properties, and the required microstructure. Due to its versatile quenching performance, oil is the most widely used quenching medium, next only to water. The worldwide requirement for quenching oil today is estimated at between 50 million and 100 million gallons per year.

Among the various quenching media, oil continues to be favored because its quenching mechanism and cooling curves are well suited to the TTT (time, temperature, and transformation) and CCT (continuous cooling transformation) diagrams of many types of steel.

Quenching of steel in liquid medium consists of three distinct stages of cooling: the vapor phase, nucleate boiling, and the convective stage. In the first stage, a vapor blanket is formed immediately upon quenching. This blanket has an insulating effect, and heat transfer in this stage is slow since it is mostly through radiation. As the temperature drops, the vapor blanket becomes unstable and collapses, initiating the nucleate boiling stage.

Heat removal is the fastest in this stage, due to the heat of vaporization, and continues until the surface temperature drops below the boiling point of the quenching medium. Further cooling takes place mostly through convection and some conduction.

During the quenching process, there are two sorts of stresses involved: thermal stresses due to rapid cooling, and transformation stresses due to the increase in volume from austenite to Martensite microstructure. Those stresses can cause excessive distortion or even cracks. However, oil has a unique desirable cooling response in minimizing those effects. Consequently, oil will continue to be used for quenching as long as it is affordable.

For the application in heat baths there are several types of quenching oils suitable for steels with low to high hardenability. Thanks to the properties of these oils, it is possible to quench also into the Martensitic temperature range—i.e. in a range between 160 and 250° C.—with minimum distortion, while still obtaining the desired properties in metal parts.

Besides hardenability, selection of an oil formulation depends on part geometry and thickness, and the degree of distortion that can be tolerated. For example, hot oil is required for smaller parts with high hardenability to achieve the desired mechanical properties with minimum distortion.

Quenching oils are available with flash points ranging from 130° C. to 290° C. The operating temperature of the oil in an open quench tank is normally at least 65° C. below its flash point. When the quench tank is operated under a protective atmosphere, oil can be used at as high as 10° C. below the flash point. The operating range of a heat bath quenching oils is normally from 10° C. to 230° C.

A lower operating temperature is in any case helpful in minimizing thermal degradation of the oil.

Originally, oil was used without any additives. It was slow in cooling and susceptible to oxidation. Research was carried out to overcome these shortcomings by adding certain chemical additives to the oil. In addition, the objective was to make oil quenching more reliable and uniform, and to control the vapor phase by starting the nucleate boiling stage sooner. Consequently, the term "fast oil" is applied to oil with such additives. Some oils also have additives that extend the nucleate boiling stage to achieve deeper hardening for some steel. Specially formulated oils also are available for vacuum heat-treating operations.

The use of vegetable oils mixtures for quenching purposes is described for instance in the patent application WO2004/099450 disclosing a vegetable quenching oil composition and additive substances which should achieve the stabilization of the chemical and technological properties of the mixtures.

However, although the benefits of using vegetable oils are various, specifically, safety, disposal, and availability, there are still some concerns regarding the metallurgical effectiveness and specific chemical and physical properties of the used mixture. In particular, a vegetable mixture achieves generally to obtain a controlled quick cooling of the treated metal but this leads to a considerably high percentage of creeks and deformations in the internal metal structure due to the difference between its superficial and internal temperature during quenching. In addition, the vegetable nature of the oil presents many drawbacks due to the various substances contained originally in the oil, which tends quickly to degrade and needs to be regenerated.

SUMMARY OF THE INVENTION

The inventive subject matter provides apparatus, systems and methods in which a fluid composition for quenching processes achieves a controlled quenching during which the cooling process can be conducted quickly, but without affecting the structure of the treated metal.

Another object of the invention is also a tempering fluid composition with a good stability and biodegradability.

A further object of the invention is to provide a fluid quenching composition which allows to achieve a high recovery of both tempering material and tempered metal after every use.

Still another object of the invention is to provide a quenching composition which does not need an on-line regeneration due to degradation and formation of unwanted by-products.

In preferred embodiments, the quenching fluid composition is prepared by esterification of (a) at least one synthetic alcohol and (b) a mixture of fatty acids, including at least oleic and linoleic acids, and at least one of a mixture comprising Myristic acid, Palmitoleic acid, Margarinic acid, Margaroleic acid, α-Linoleic acid, Arachidic acid, Eicosenoic Behenic acid, and Erucic acid. The fatty acids can also include at least one of stearic acid and palmitic acid.

The composition preferably contains no more than 85% w/w of oleic acid, and no more than 6 to 10% w/w of linoleic acid.

The composition can be used as, or as part of, a quenching bath for a metal.

Various objects, features, aspects and advantages of the inventive subject matter will become more apparent from the following detailed description of preferred embodiments.

DESCRIPTION OF THE INVENTION

Figure 1:
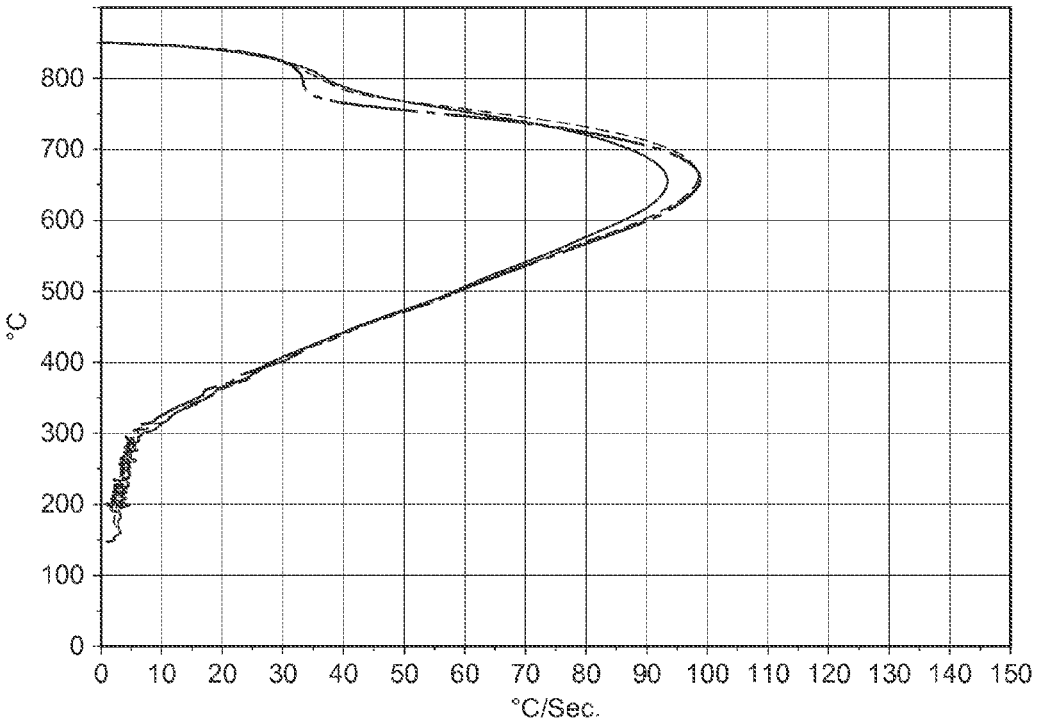
FIG. 1 depicts typical cooling curves of a prior art vegetable oil as in WO 2004/099450 and a summary table of cooling properties of such an oil.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

A preferred quenching fluid composition according to the present invention can be prepared by esterification of:

(a) at least one synthetic alcohol; and (b) a mixture comprising:

from 65 to 85% w/w of oleic acid;

from 6 to 10% w/w of linoleic acid;

from 0 to 3% w/w of stearic acid;

from 0 to 3.8% w/w of palmitic acid; and 1.5 to 6% w/w in total composed of at least one of a mixture comprising Myristic, Palmitoleic, Margarinic, Margaroleic, α-Linoleic, Arachidic, Eicosenoic, Behenic, and Erucic acid.

It has been found that the best results in terms of metallurgical properties, together with chemical and physical stability can be obtained when the synthetic alcohol is selected from Trimethylolpropane trioleate, Pentaerythritol tetraoleate and Neopentyl glycol dioleate. This composition does not involve the use of natural, vegetable oils, so that all the cited problems strictly related to their use have been avoided.

Despite being a synthetic product, the object of the present invention is particularly suited as quenching fluid composition with low environmental impact and is also characterized by a high biodegradability and no toxicity.

As for quenching oils of vegetable origin, the composition results transparent and clear, thus avoiding the formation of the "ash of deposit" always leaved behind on the metal after the immersion in mineral oil baths. This layer not only affects the brightness and the cleanliness of the metal surface but is also difficult to be removed from the metal surface. However, removing vegetable oil baths from quenched-metal surfaces always requires the employment of specific detergents belonging to the family of Alkylpolyethylene Glycol Ether.

Said detergents are not necessary when using the composition of the present invention, which can be easily removed from the metal parts without the need of extra-washing methods after the heat treatment.

The synthetic composition according to the present invention is thermally very stable. However, as a precautionary measure for assuring practically the 100% on recovery value, different stabilizing additives may be used. Those additives are well known in the art and can be chosen among the group consisting of Octyl-Butyl Diphenilamine, long-chain sulphonate acid salts, phenols derivatives and Benzotriazoles like the N,N-bis(2-ethylhexyl)-4-methyl-1H-benzotriazole-1-methylamine and the N,N-bis(2-ethylhexyl)-5-methyl-1H-benzotriazole-1-methyllamine.

They are intended to stabilize the composition without compromising the chemical and physical characteristics of the oil mixture and in conformity with the main properties of the fluid, i.e. the biodegradability and the low toxicological impact. By completely avoiding the thermal degradation and by adding stabilizing compounds, the fluid thus offers a 100% recovery value as regards the oil reclaiming and the tempering technological effect on metals.

In fact, the bath can be reutilized without the need of being regenerated, neither in situ nor in a separate plant, avoiding in this way any environmental costs. Thanks to the definitely longer "life time" of the present quenching composition in comparison with the previous ones of vegetable nature and due to the property of always preserving its initial qualities, the product disclosed in the present application represents the best possible medium in the field of metals quenching.

Furthermore, the fluid composition of the present invention allows to obtain a high tempering performance as regards the number of tempered metals and their resulting physical qualities: in the case of a vegetable oil bath, the maximal recovery obtainable, i.e. the maximal quantity of resulting tempered metal without deformations, creeks or other deficiencies, is approximately 96%. By employing the present tempering oil composition as quenching bath, this value rises up to 99.9%.

COMPARATIVE EXAMPLES

As mentioned previously, the synthetic composition according to the present invention shows particular advantages when compared with quenching products of vegetable origin. Those advantages will become more apparent by the following comparison, focusing on the main chemical and technological properties of those two baths. The following examples have a pure explanatory nature and should be therefore interpreted without any restriction to the general inventive concept of the present invention.

1. Stability to Oxidation and Reproducibility of Bath Behavior

The following table shows the better stability to oxidation and the higher procedural reliability of the present synthetic composition in comparison with two vegetable quenching oils as disclosed in WO2004/099450. In particular, the tests have been conducted by employing a quenching composition according to the present invention resulting from the employment of Trimethylolpropane trioleate (TMP) Pentaerythritol (PE) tetraoleate and Neoppentyl glycol (NPG) dioleate as reacting alcohol.

| Oxidation Time [hour] | Properties | Vegetable Oil 1 | Vegetable Oil 2 | TMP Oleate | PE Tetraoleate | NPG Dioleate |
|---|---|---|---|---|---|---|
| 0 | Acid Value [mgKOH/g] | 0.44 | 0.38 | 0.66 | 0.54 | 0.62 |
| | Viscosity at 40° C. [cSt] | 40.7 | 42.10 | 50.13 | 66 | 32 |
| 168 | Acid Value [mgKOH/g] | 4.23 | 5.20 | <1 | <1 | <1 |
| | Viscosity at 40° C. [cSt] | 65.61 | 80.10 | 63 | 74.2 | 42.5 |
| Fatty Acids Composition [weight %] | Palmitic Acid (C16:0) | 6.2 | 35 | 3 | 3.2 | 3 |
| | Steric Acid (C18:0) | 3.5 | 4 | 2.8 | 2.5 | 2.5 |
| | Oleic Acid (C18:1) | 30 | 44.5 | 74 | 75.5 | 73.4 |
| | Linoleic Acid (C18:2) | 50 | 13 | 8.8 | 8.4 | 9 |

The testing conditions foresee the flux of 1 liter/hour of air inside the oil bath heated at 120° C. for 168 hours for observing the chemical and physical behavior of the oils.

As it becomes apparent from the above results, after 168 hours the acidic value and the viscosity of the composition according to the present invention show very small variations if compared with the vegetable oils, what represents a clear indication for greater stability of the synthetic bath.

Contrarily to oils 1 and 2, the esters of the invention do not undergo any significant aging and degradation processes leading to the formation of by-products, and the practically constant viscosity value is an indication that even the bath temperature remains the same after the quenching treatment, what makes the composition always ready-to-operate at the most effective conditions and with the most reproducible qualitative results on the tempered metals.

2. Less-Drastic Cooling Behavior

Figure 2:
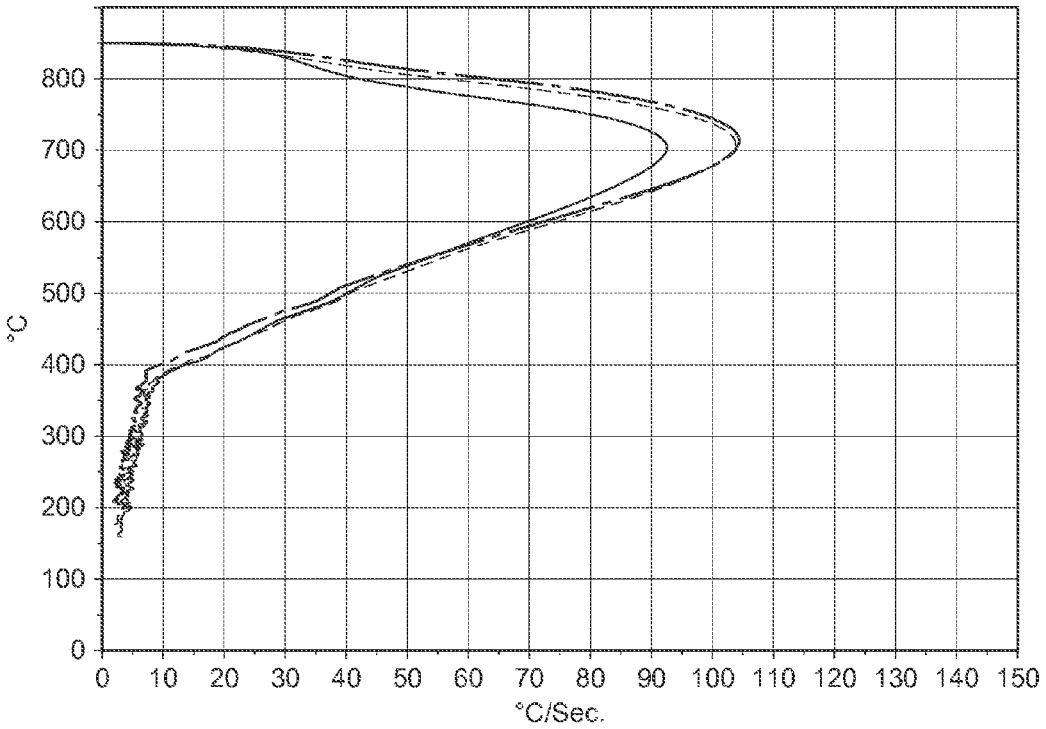
FIG. 2 depicts typical cooling curves of an oil of the inventive concept and a summary table of cooling properties of such an oil.

FIG. 1 and FIG. 2 provide diagrams that represent the cooling curves of the vegetable oil 1 according to the state of the art (FIG. 1) and of the esters resulting from the use of TMP as alcohol according to the present invention (FIG. 2).

As shown in the comparison, especially in the range below 450° C., which structurally is the most important and decisive interval of the whole quenching process, the composition according to the present invention show a slower cooling rate, what leads to a better homogenization of the surface- and inner temperature of the treated metal before reaching the Martensite point.

Thanks to this property, any possible risk of creeks, breaks or deformations is completely avoided.

3. Better Metallurgic Results

From metallurgic essays conducted with both vegetable and synthetic oils baths it has been observed that the differences cited under points 1 and 2 above lead to the advantage that the ester composition according to the present invention allows a more penetrating and thus more uniform cooling effect and therefore to a resulting higher hardness of the metals. This applies in particular to low-alloy metals steels (e.g. C40, C43, 20MnCr5).

The quenching fluid formulation of the present invention has been used in tempering processes at different temperatures both in covered and opened tank bath. The composition is preferably employed at a temperature ranging from 60 C.° to 80 C.°, more preferably between 65 C.° and 75 C.° at which the best results have been observed. Under controlled atmosphere, the working temperature of the bath can be brought up to 200° C. Analytical and physical-chemical analyses have been performed on the synthetic oils, giving the following results:

| I. TMP | | | |
|---|---|---|---|
| | | TMP TRIOLEATE | |
| CHEMICAL NAME | U.M. | Test methods | Range |
| Physical status 25° C. | | Visual | Liquid |
| Acid value | mgKOH/g | AOCS Cd3d-63 | ≤3.0 |
| Saponification value | mgKOH/g | AOCS Cd3-25 | 170.0 – 195.0 |
| Colour | | ASTM D1500 | ≤3 |
| Density at 20° C. | g/cc | ASTM D1298-85 | 0.910 – 0.9250 |
| Pour point | ° C. | ASTM D97-87 | ≤−30 |
| Viscosity at 40° C. | cSt | ASTM 445-94 | 45 – 54 |
| Flash point | ° C. | AOCS Tn1a-64 | ≥300 |

| II. PE Tetraoleate | | | |
|---|---|---|---|
| | | PENTAERYTRITYL TETRAOLEATE | |
| CHEMICAL NAME | U.M. | Test methods | Range |
| Physical status 25° C. | | Visual | Liquid |
| Acid value | mgKOH/g | AOCS Cd3d-63 | ≤3.0 |
| Iodine value | $gI_2/100$ | AOCS Tg2a-64 | 85.0 – 95.0 |
| Saponification value | mgKOH/g | AOCS Cd3-25 | 170.0 – 195.0 |
| Colour | | ASTM D1500 | ≤5 |
| Density at 20° C. | g/cc | ASTM D1298-85 | 0.905 – 0.925 |
| Pour point | ° C. | ASTM D97-87 | ≤−20 |
| Viscosity at 40° C. | cSt | ASTM 445-94 | 65 – 78 |
| Flash point | ° C. | AOCS Tn1a-64 | ≥300 |

| III. NPG Dioleate | | | |
|---|---|---|---|
| | | NPG DIOLEATE | |
| CHEMICAL NAME | U.M. | Test methods | Range |
| Physical status 25° C. | | Visual | Liquid |
| Acid value | mgKOH/g | AOCS Cd3d-63 | ≤2.5 |
| Saponification value | mgKOH/g | AOCS Cd3-25 | 170.0 – 195.0 |
| Colour | | ASTM D1500 | ≤2.5 |
| Density at 20° C. | g/cc | ASTM D1298-85 | abt 0.910 |
| Pour point | ° C. | ASTM D97-87 | ≤−15 |

-continued

| III. NPG Dioleate | | | |
|---|---|---|---|
| | | NPG DIOLEATE | |
| CHEMICAL NAME | U.M. | Test methods | Range |
| Viscosity at 40° C. | cSt | ASTM 445-94 | 29 – 35 |
| Flash point | ° C. | AOCS Tn1a-64 | ≥250 |

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A synthetic quenching fluid composition prepared by esterification of:

(a) at least one synthetic alcohol; and (b) a mixture comprising:

from 65 to 85% w/w of oleic acid;

from 6 to 10% w/w of linoleic acid;

from 0 to 3% w/w of stearic acid;

from 0 to 3.8% w/w of palmitic acid; and 1.5 to 6% w/w in total composed of at least one of Myristic acid, Palmitoleic acid, Margarinic acid, Margaroleic acid, Arachidic acid, Eicosenoic, Behenic acid, and Erucic acid.

2. The composition according to claim 1, further comprising an antioxidant stabilizing additive or a mixture of two or more such additives.

3. The composition according to claim 1, wherein the synthetic alcohol is selected from the group consisting of Trimethylolpropane trioleate, Pentaeryrthritrol tetraoleate and Neopentyl glycol dioleate.

4. The composition according to claim 3, further comprising at least one anti-oxidant stabilizing additive.

5. The composition according to claim 3, wherein the at least one antioxidant stabilizing additive is selected from the group consisting of Octyl-Butyl Diphenylamine, long-chain sulphonate acid salts, phenol derivatives and Benzotriazoles.

6. The composition of claim 5, wherein the Benzotriazole is selected from the group consisting of N,N-bis(2-ethylhexyl)-4-methyl-1H-benzotriazole-1-methylamine and N,N-bis(2-ethylhexyl)-5-methyl-1H-benzotriazole-1-methylamine.

7. A method of quenching a metal, comprising:

providing a quenching composition comprising a) at least one synthetic alcohol; and (b) a mixture comprising:

from 65 to 85% w/w of oleic acid, from 6 to 10% w/w of linoleic acid, from 0 to 3% w/w of stearic acid, from 0 to 3.8% w/w of palmitic acid, and 1.5 to 6% w/w in total composed of at least one of Myristic acid, Palmitoleic acid, Margarinic acid, Margaroleic acid, Arachidic acid, Eicosenoic, Behenic acid, and Erucic acid; and contacting the metal with the quenching composition.

8. The method of claim 7, wherein the synthetic alcohol is selected from the group consisting of Trimethylolpropane trioleate, Pentaeryrthritrol tetraoleate and Neophentyl glycol dioleate.

9. The method of claim 8, wherein the quenching composition further comprises at least one anti-oxidant stabilizing additive.

10. The method of claim 9, wherein the antioxidant stabilizer is selected from the group consisting of Octyl-Butyl Diphenylamine, long-chain sulphonate acid salts, phenol derivatives and Benzotriazoles.

* * * * *

UNITED STATES PATENT AND TRADEMARK OFFICE

CERTIFICATE OF CORRECTION

PATENT NO. : 9,303,293 B2
APPLICATION NO. : 14/101101
DATED : April 5, 2016
INVENTOR(S) : Augusto Parodi et al.

It is certified that error appears in the above-identified patent and that said Letters Patent is hereby corrected as shown below:

Please replace claim 3, column 8, lines 1-4 with claim 3 as listed below:

3. The composition according to claim 1, wherein the synthetic alcohol is selected from the group consisting of Trimethylolpropane, Pentaeryrthritrol and Neopentil glycol.

Please replace claim 7, column 8, lines 16-27 with claim 7 as listed below:

7. A method of quenching a metal, comprising:
providing a quenching composition comprising
at least one ester of a synthetic alcohol and
a mixture comprising:
from 65 to 85% w/w of oleic acid,
from 6 to 10% w/w of linoleic acid,
from 0 to 3% w/w of stearic acid,
from 0 to 3.8% w/w of palmitic acid, and
1.5 to 6% w/w in total composed of at least one of Myristic acid, Palmitoleic acid, Margarinic acid, Margaroleic acid, Arachidic acid, Eicosenoic, Behenic acid, and Erucic acid; and
contacting the metal with the quenching composition.

Please replace claim 8, column 8, lines 29-32 with claim 8 as listed below:

8. The method of claim 7, wherein the synthetic alcohol is selected from the group consisting of Trimethylolpropane, Pentaeryrthritrol and Neopentil glycol.

Signed and Sealed this
Ninth Day of August, 2016

Michelle K. Lee

Michelle K. Lee
*Director of the United States Patent and Trademark Office*